US007717267B2

(12) United States Patent
Applebaum

(10) Patent No.: US 7,717,267 B2
(45) Date of Patent: May 18, 2010

(54) SNAP-LOCK TWIST-OPEN CARD AND BLISTER PACKAGE

(76) Inventor: Paul Applebaum, 16371 Wimbledon Ave., Huntington Beach, CA (US) 92649

( * ) Notice: Subject to any disclaimer, the term of this patent is extended or adjusted under 35 U.S.C. 154(b) by 0 days.

(21) Appl. No.: 12/283,599

(22) Filed: Sep. 15, 2008

(65) Prior Publication Data

US 2010/0065460 A1 Mar. 18, 2010

(51) Int. Cl.
*B65D 75/28* (2006.01)
*B65D 73/00* (2006.01)
*B65D 85/00* (2006.01)

(52) U.S. Cl. ..... 206/461; 206/1.5; 206/464

(58) Field of Classification Search ..... 206/461–471, 206/1.5, 807, 776; 220/293, 298
See application file for complete search history.

(56) References Cited

U.S. PATENT DOCUMENTS 4,512,474 A * 4/1985 Harding ..... 206/461
4,684,024 A * 8/1987 Ebrahim et al. ..... 206/464
4,739,883 A * 4/1988 Mohs et al. ..... 206/470
4,884,718 A * 12/1989 Leahy ..... 220/835
5,046,659 A * 9/1991 Warburton ..... 220/4.22
5,593,036 A * 1/1997 Dyble et al. ..... 206/464
5,788,105 A * 8/1998 Foos ..... 220/266
6,244,444 B1 * 6/2001 Jacobus et al. ..... 206/703
7,404,487 B2 * 7/2008 Kumakura et al. ..... 206/469
2006/0213800 A1 * 9/2006 Ballard et al. ..... 206/470

* cited by examiner

*Primary Examiner*—Mickey Yu
*Assistant Examiner*—Steven A. Reynolds

(57) ABSTRACT

A card and blister package for small articles of commerce has a clear plastic blister piece, a card and a retainer piece. The blister piece had an article-receiving cavity and a flange extends along the upper edge of the cavity, and pluralities of upwardly extending locking posts are spaced apart along the flange. The card has openings for receiving therethrough the locking posts and the retainer piece had a plurality of integral downwardly-opening locking caps spaced therealong, whereby when the posts are engaged through the card openings the caps can be snapped into locking engagement with the blister posts so as to secure the card to the blister. Each cap is encircled by an arrangement of perforations, so as to detachably connect the cap to the retainer piece and whereby twisting of the cap will cause it to shear free of the retainer, and rotation through about 90 degrees will cause the caps to unlock from the posts, allowing the package to be opened.

20 Claims, 11 Drawing Sheets

SNAP-LOCK TWIST-OPEN CARD AND BLISTER PACKAGE

BACKGROUND OF THE INVENTION

1. Field of the Invention

The present invention relates to card and blister type packages, and more particularly to a three piece package having fastening features that can be snapped into locking engagement and disengaged by rotation of the features.

2. Description of the Prior Art

Card and blister packages are widely used for packaging small articles of commerce. Typically such a package will have a clear plastic blister piece; i.e. open topped enclosure that has a flange. The card has one side coated with a layer of dry adhesive. At a typical packaging station the product is placed in the blister cavity of a supported blister piece, then the card is placed over the blister with its adhesive-coated side engaged with the blister flange. The subsequent application and removal of heat and pressure along the flange causes the adhesive to liquefy, and a bond is formed between card and flange. The liquid adhesive on the remainder of the card will return to its dry state and remain on the card.

Today it is an ecologically responsible practice to recycle packaging materials, and for card and blister packages this requires in the first instance to separate the plastic component from the paper-based card component. With conventional packages the separation of source materials is often not complete since portions of the card will remain adhesively attached to the flange of the plastic blister portion, and printed paper torn from the face of the card, and as mentioned above, a significant amount of dried adhesive will remain on the discarded card.

Another drawback with other conventional clamshell style packages is that, in the interest of providing a package that is secure against tampering and pilferage, they are becoming quite difficult for the ordinary purchaser to open, and this has even resulted in serious injury to the hand and fingers.

SUMMARY OF THE INVENTION

In view of the foregoing it is a general object of the invention to provide an improved card and blister package and an alternative to conventional clamshell packages.

A more specific object is to provide a card and blister package that offers the highest level of security desired by the retailer, yet is relatively easy for the purchaser to open.

Another object is to provide a card and blister package that is ecologically sound by lending itself to easy and effective source separation of its plastic and paper-based components for recycling of the used package materials.

A further object is to provide a package that has a recyclable card free of adhesive residue, and a plastic blister portion that is free of paper residue transferred from the card.

Yet a further specific object is to provide a card and blister package-having components that can be easily snapped into a locking configuration, requiring little to no adhesive sealing to be effective, and which can be opened by rotation of novel integral locking caps.

These and other objects and advantages are provided by the present invention of a card and blister package that includes a clear plastic blister piece, a card, and a retainer piece. The blister piece includes an article-receiving cavity and a flange portion, and a plurality of first connector elements is spaced apart along the flange. The retainer ring includes a frame with a plurality of second connector elements spaced therealong, these second connector elements adapted for being snapped into locking engagement with the first elements.

The card has a plurality of openings, and the package has a closed configuration in which the card covers the blister cavity and the respective first and second connector elements are locked with each other by way of the card openings to secure the card between retainer frame and blister flange. The invention further features means on the respective connectors that allow them to be unlocked when the retainer connectors are rotated through about 90 degrees. There is a region/line of lessened structural integrity about each of the blister connector elements which is adapted to be severed so as to provide a disconnected segment that, inclusive of the connector element, can then be free to be rotated relative the remainder of the frame.

In one preferred embodiment the first connector elements comprise upwardly extending locking posts, and the second connectors are integral downwardly-opening locking caps More specifically, each of the blister locking posts has at least one side portion containing a generally concave locking cavity and the cap interior has resiliently deformable, inwardly projecting convex locking means that will resiliently deform when engaged by a locking post and then spring inwardly into locking engagement with the post locking cavity when the post is fully inserted in the locking cap.

In a preferred embodiment each of the integral locking caps is encircled by a line of lessened structural integrity in the body of the retainer ring whereby manual rotation of the cap relative to the retainer ring will cause separation along the line. Rotation of the cap of a locked package through about 90 degrees will move the locking means out of engagement with the locking cavities so as to free the cap for vertical separation from the post.

In one variant of the invention the second connector element includes a downwardly projecting member having at least one locking lug projecting outwardly from the lower end of the member and the first connector element has walls that define an opening for receiving the lower end of the member, and including at least one inwardly projecting resiliently deformable flap adjoining the opening and which flap is adapted to be engaged by the lug, whereby said second connector is locked into engagement with the first connector when said lug is moved downwardly against said flap to cause it to deform and then snap into engagement with the upper edge of the lug upon further downward movement of the lug. Rotation of the member through about 90 degrees will move the lug out of engagement with the flap and into the opening to allow the member to be vertically withdrawn. In this variant the retainer frame has a lower surface for engaging the card, and the severable segment is thinner than the remainder of the frame and spaced above the level of the frame lower surface to create an opening of insertion of cutting blades, and the line of lessened structural integrity comprises at least one transversely extending groove.

In yet another variant, on each side of a retainer connector there is an integral detachable strip in the retainer frame that is defined by transversely extending perforations, and a pull tab or ring at one end of the strip can be pulled in a manner to detach the strip from the retainer frame.

DETAILED DESCRIPTION OF THE INVENTION

Figure 1:
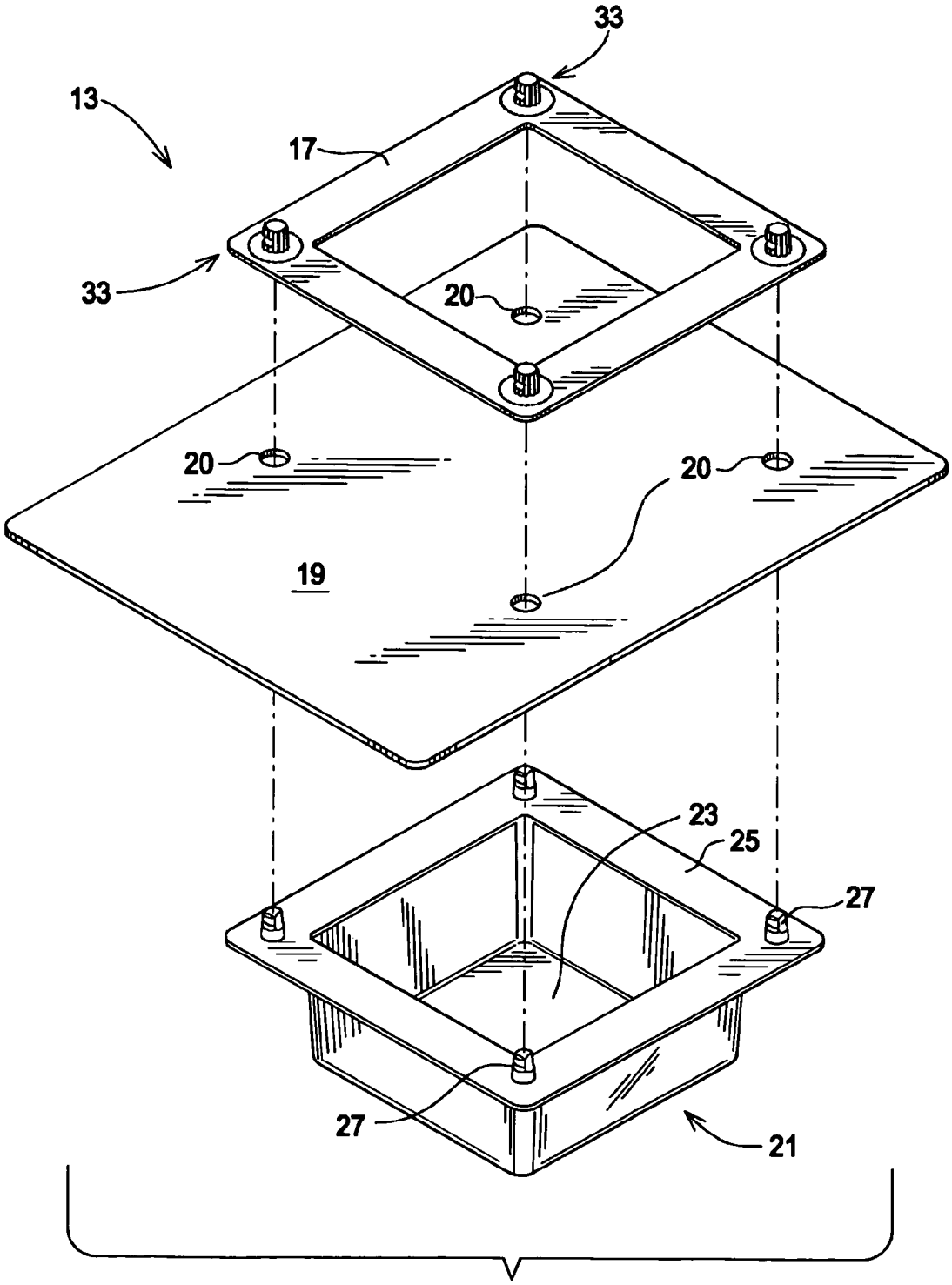
FIG. 1 is an exploded perspective view of a snap-lock twist-open card-and-blister package according to the present invention.

Referring now to the drawings, FIG. 1 shows that in a preferred embodiment of a snap-lock twist-open card and blister package 13 according to the present invention the main components comprise a retainer ring 17, a card 19 and a blister piece 21. Ring 17 and blister 21 are each formed using techniques known in the plastics molding industry. Blister piece 21 has article-receiving cavity 23, and has locking posts 27 that extend from flange 25.

Figure 4:
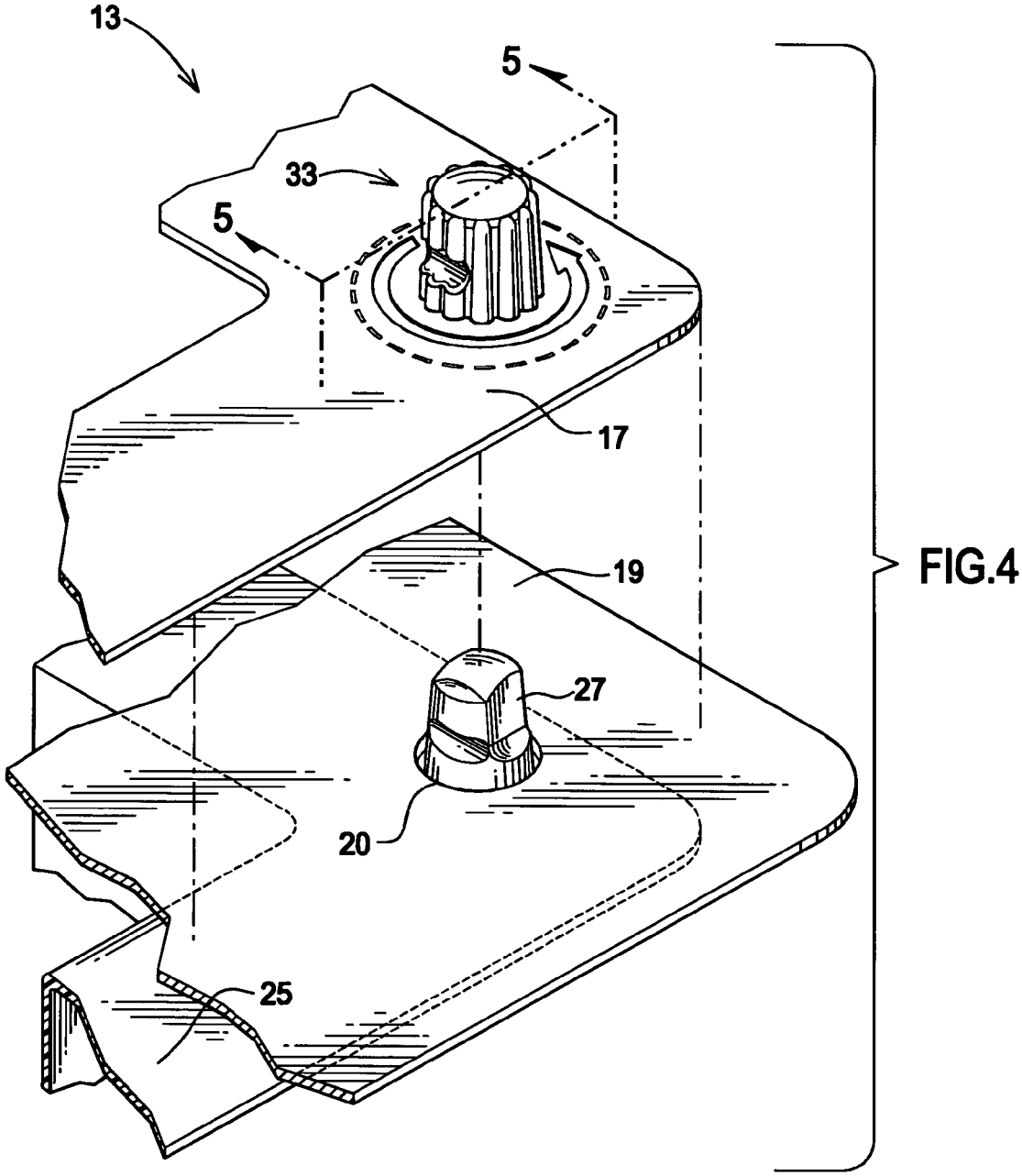
FIG. 4 is an enlarged perspective partial view of a package according to the present invention.
Figure 9:
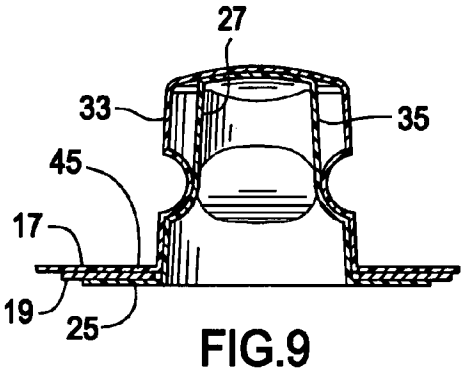
FIG. 9 is a sectional view taken along the line 9-9 of FIG. 7.

As shown in FIG. 4, and best in FIG. 5, locking post 27 have a pair of opposing beveled or slanted upper edges 29, and a pair of opposing, transversely extending concave locking cavities 31 aligned below the respective slanted edges 29. As shown in FIG. 4 and FIG. 9 rotationally at 90 degrees from the cavities 31, are opposed generally vertical faces 35.

FIG. 1 illustrates how the card 19 is provided with openings 20 for receiving posts 27.

Figure 5:
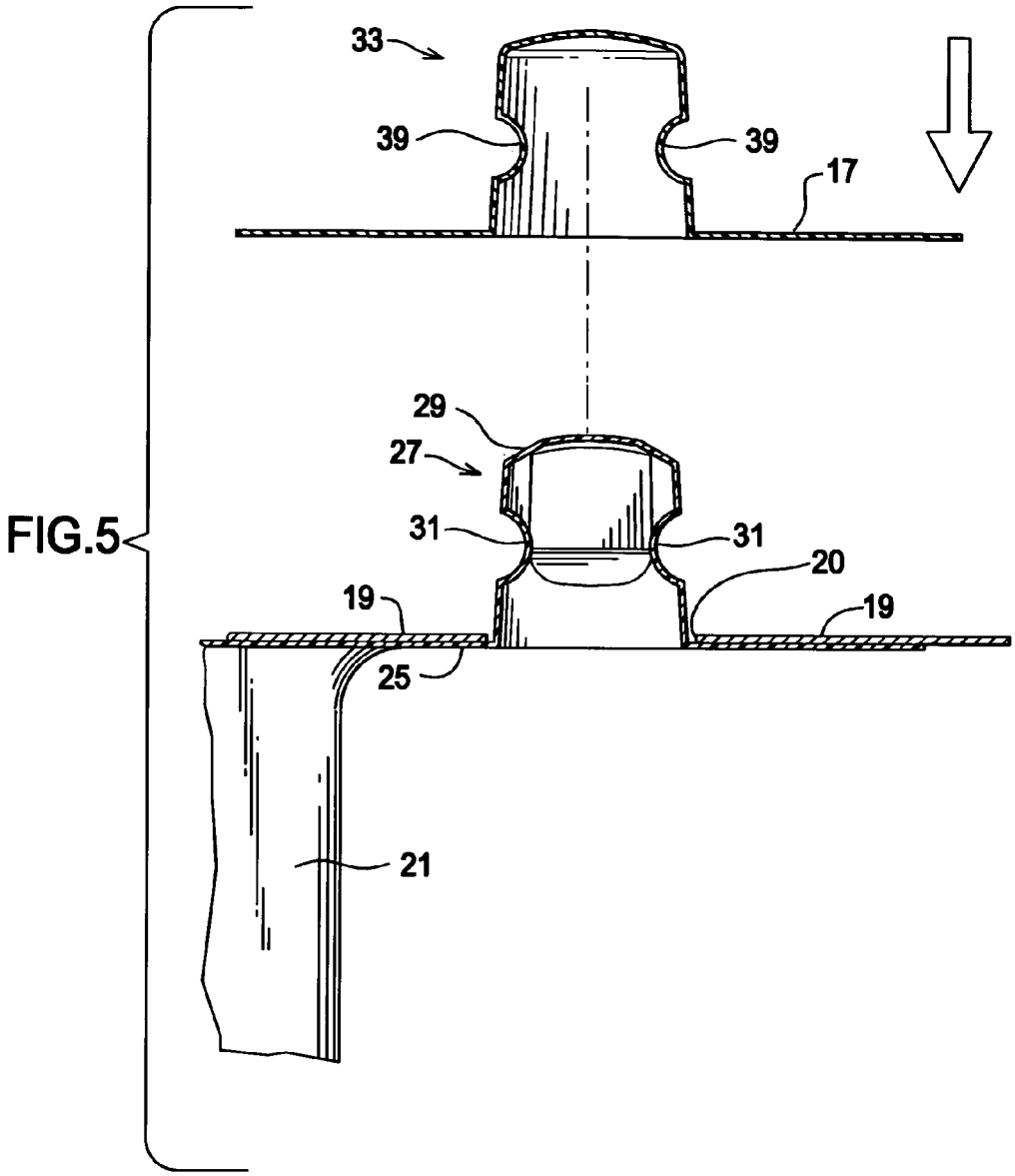
FIG. 5 is a sectional view taken along the line 5-5 of FIG. 4.

FIG. 5 shows that the downwardly opening cap 33 has convex transverse locking protuberances 39. Conventional plastics forming techniques are used to provide, in a predetermined manner, the protuberance and cap wall structure with the desired strength, flexibility and resiliency to allow the protuberances 39 to be resiliently urged apart when they are pushed into slidable engagement with the post chamfered edges 29 when a package is closed, in a manner to be described.

FIG. 4 shows how each cap 33 is encircled by a line 43 of perforations in the body of retainer ring 17. This provides a corresponding number of bridging segments that are designed to shear under torque generated when a cap is unlocked, in a manner to be described. Within circle 43 there is a skirt-like portion 45 upon which an arrow 49 for indicating the twist-open direction, is imprinted.

Figure 8:
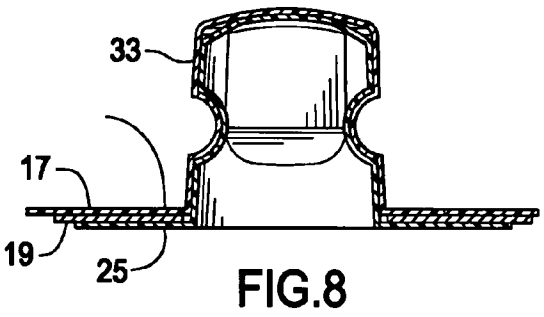
FIG. 8 is a sectional view taken along the line 8-8 of FIG. 6.

Closing and locking a package 13 occurs as follows. After articles are placed in the blister cavity 23, the locking posts 27 are inserted through the openings 20 of the card 19. Then the locking caps 33 of the retainer ring are aligned with the posts 27 as FIG. 4 illustrates, and then moved downwardly towards engagement with the posts as suggested in FIG. 5. It can be appreciated, by reference to FIG. 5 how the cap protuberances 39 will slideably engage the chamfered edges 29 of a post, so as to resiliently spread apart the protuberances, and how further insertion will allow the flexed protuberances 39 to "spring" or snap into engagement with the twin cavities 31, to provide a locked configuration as FIG. 8 shows.

Figure 2:
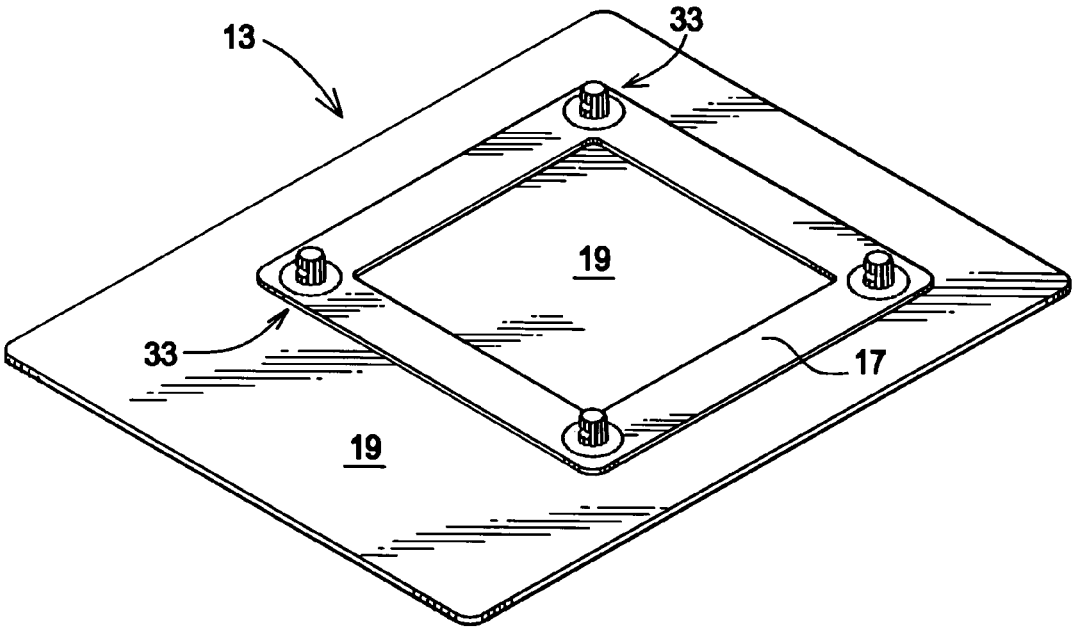
FIG. 2 is a top perspective view of an assembled package according to the present invention.
Figure 3:
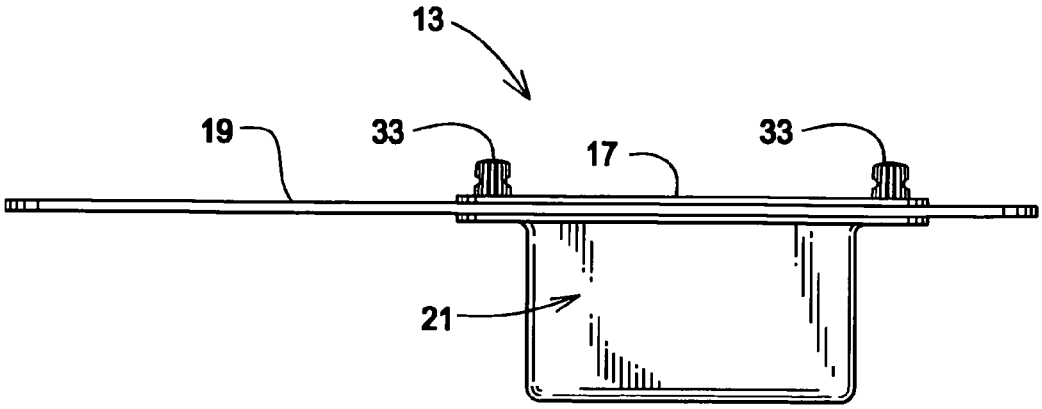
FIG. 3 is a side elevational view of the package of FIG. 2.

FIGS. 2 and 3 are views of a completed package 13.

Figure 6:
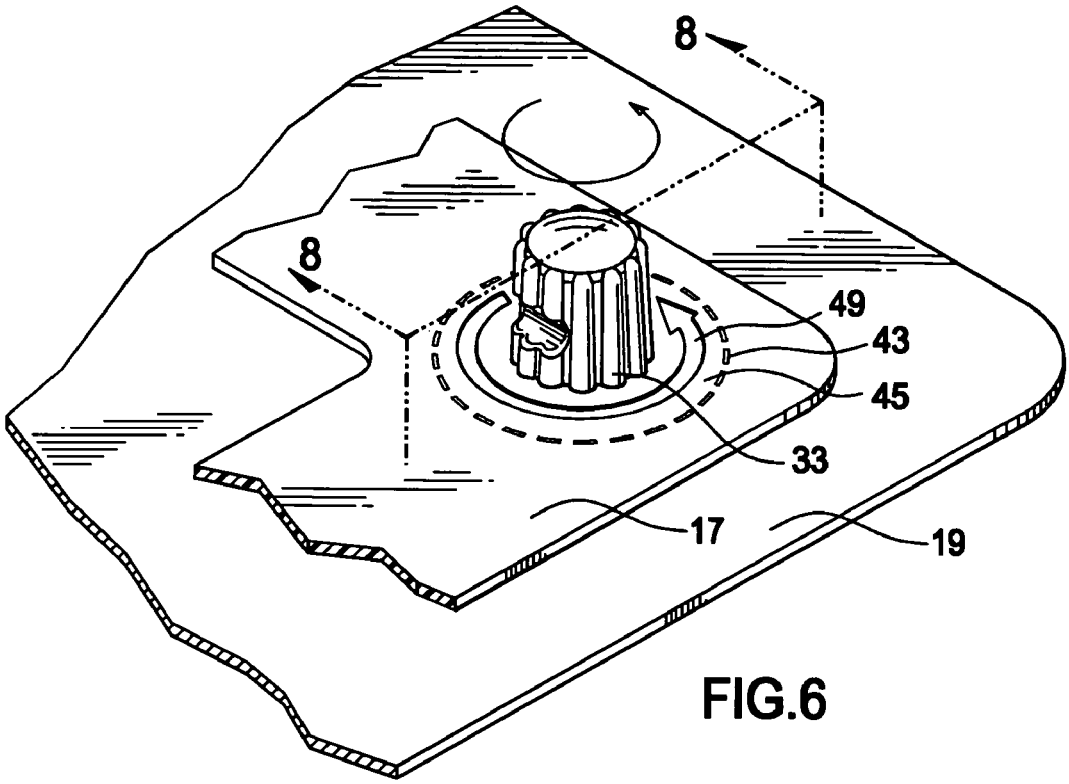
FIG. 6 is an enlarged partial, perspective view of a corner portion of an assembled package according to the present invention.
Figure 7:
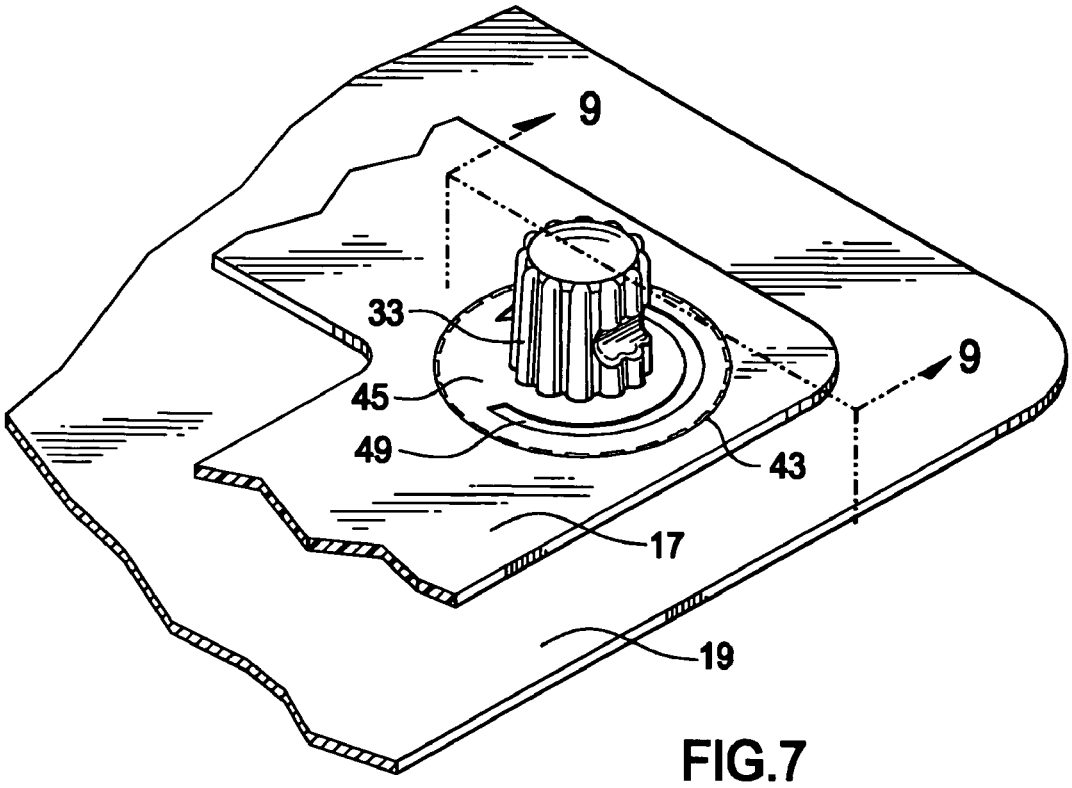
FIG. 7 is a view similar to FIG. 6, but showing the locking cap rotated through 90° to its unlock position.
Figure 10:
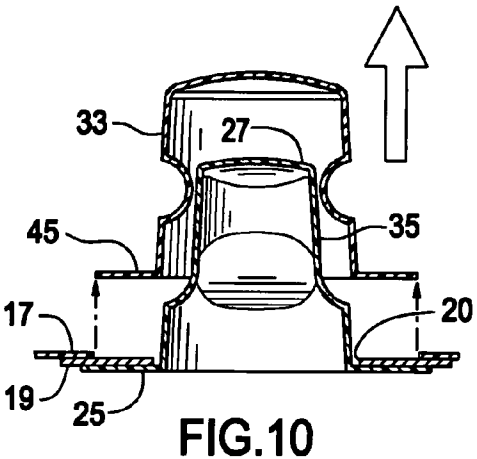
FIG. 10 is a sectional view illustrating vertical withdrawal of a rotated and detached locking cap from a locking post.

Package 13 can be unlocked and opened as follows. A locking cap 33, as shown in FIGS. 6 and 7, can be grasped by hand and then rotated for a quarter turn, i.e. 90 degrees, in the anti-clockwise direction indicated by the imprinted arrow 49. A moderate amount of torque will suffice to cause separation along line 43, as FIG. 7 shows. This provides the cap 33 with a skirt or flange 45 of material. This quarter turn to the position shown in FIG. 7 also moves the locking protuberances 39 out of the cavities 31 to a position adjoining the generally vertical faces 35. Upward movement of the protuberances 39 is thereby unrestrained, and the cap 33 including skirt 45 can then be disengaged from the pin 33 as FIG. 10 shows.

Figure 11:
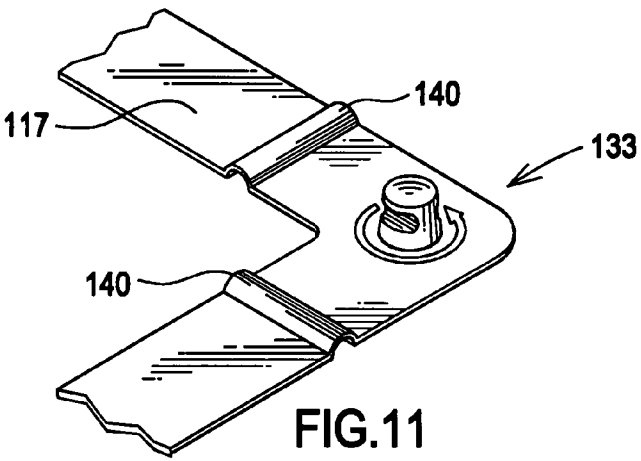
FIG. 11 is a partial perspective view of a corner portion of a variant of the present invention.

FIG. 11 shows the corner region of a retainer of a variant of the present invention, which is similarly constructed to the afore-described package 13, and includes a retainer ring 117 and locking cap 133. This variant differs by having no encircling perforations about the cap 133. Instead there are raised transverse portions 140 that are designed to be conveniently engaged by a suitable cutting tool, such as scissors. It should be appreciated that when both portions 140 are severed, the cap 133 and the adjoining segment of ring material can be rotated to unlock the cap.

Figure 12:
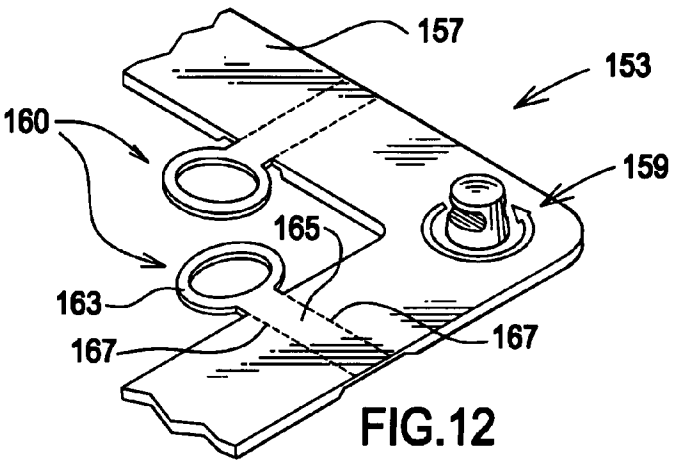
FIG. 12 is a partial perspective view of a portion of another variant of the present invention.

FIG. 12 shows the corner region of an additional variant 153, also similar to the package 13, having retainer ring 157 and locking cap 159. This variant employs pull-tab elements 160, each having an integral strip 165 bounded by the twin perforation lines 167, and a pull ring 163. To open the package, it should be appreciated how the pull rings can be manipulated to cause breakage along the lines 167 which will free up the cap 159 and adjoining material for rotation.

Figure 13:
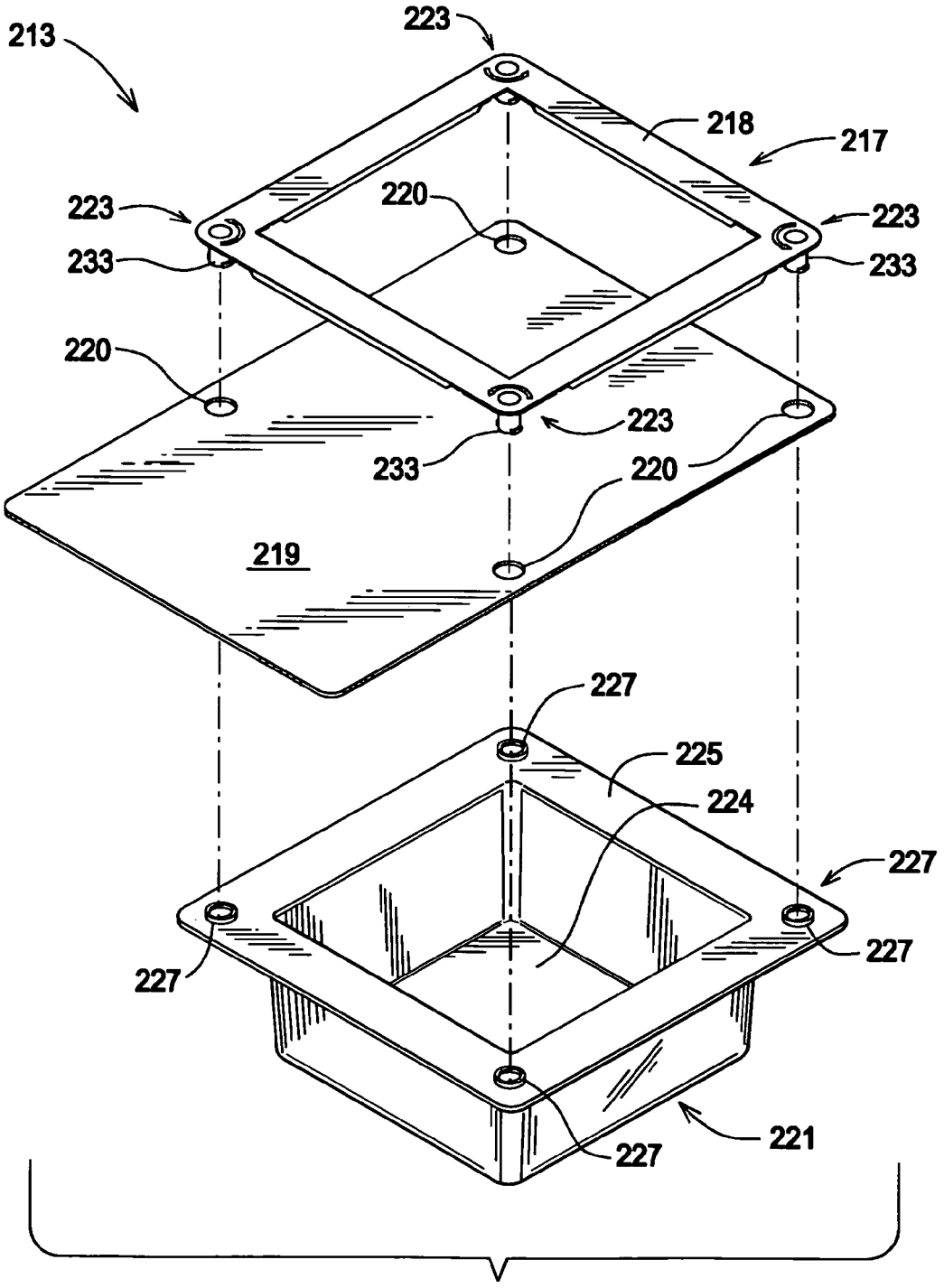
FIG. 13 is an exploded perspective view of yet another variant of a snap-lock twist-open card-and-blister package according to the present invention.

FIG. 13 shows another variant 213 of the invention that has a retainer ring 217 including frame 218 and connector elements 223. There is a card 219 that has holes 220 that are alignable with the connector elements 223. The blister piece 221 completes the package, and has article-receiving cavity 224, a flange portion 225 and connector elements 227, which are designed to engage card openings 220.

Figure 15:
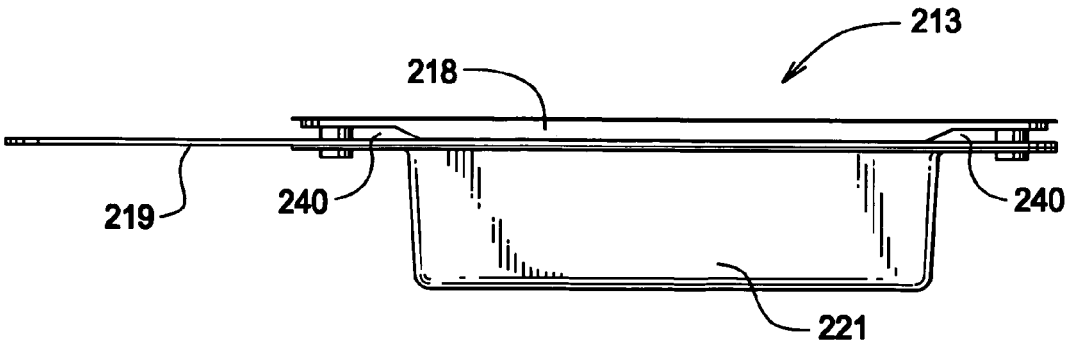
FIG. 15 is a side elevational view of the package of FIG. 14.
Figure 16:
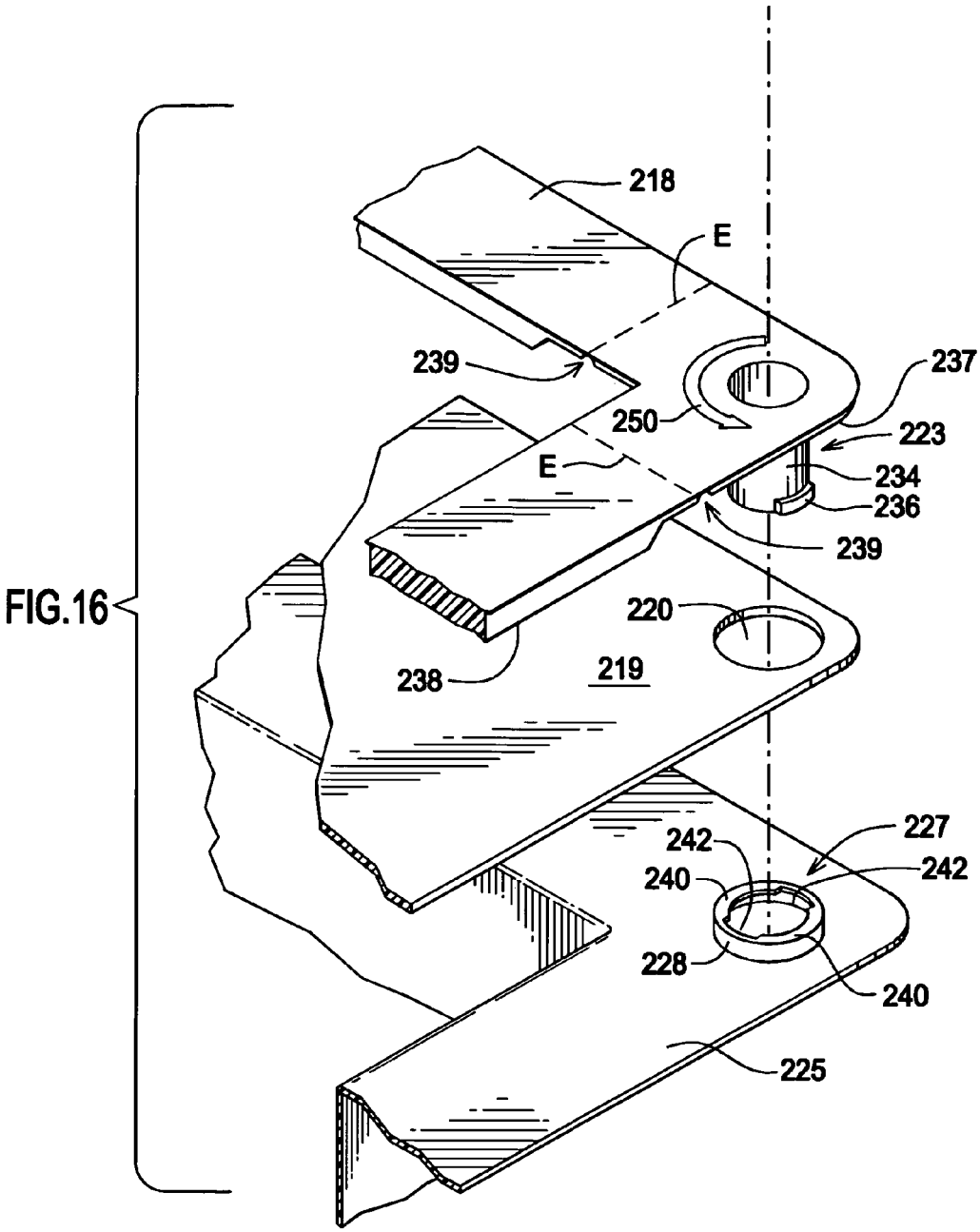
FIG. 16 is an enlarged exploded perspective partial view of a package according to the present invention.
Figure 19:
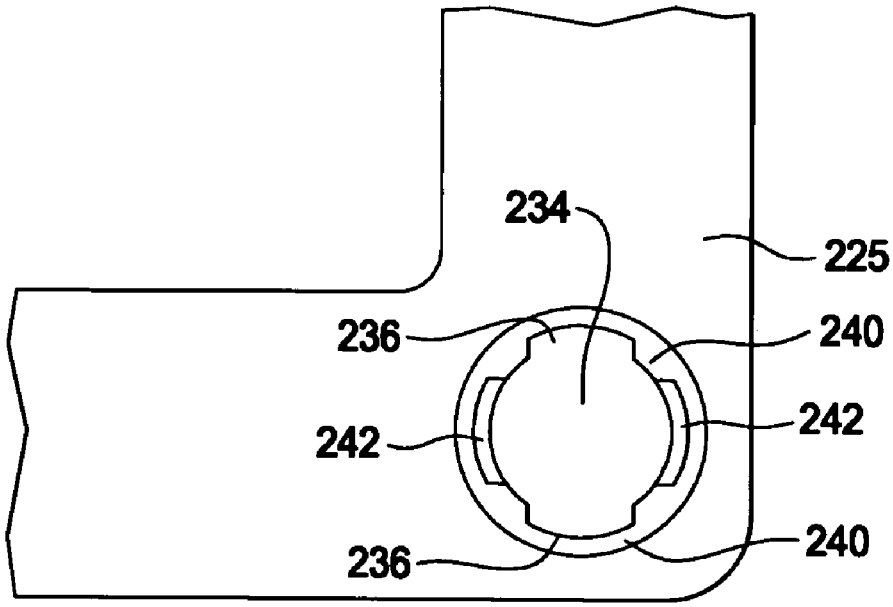
FIG. 19 is a partial bottom view of connector elements in locked configuration.

The enlarged view of FIG. 16 best shows that a typical package corner has a connector element 223 having shaft 234 and locking lugs 236 on opposing sides of its lower end. (FIG. 19 shows both lugs 236). Note that shaft 234 extends downwardly from a retainer frame web portion 237 that is thinner than frame 218 and spaced above the level of bottom surface 238 retainer frame 218. FIG. 15 best shows how, in the assembled package 213 this feature will provide a space 240 between the top of the card 219 and the retainer web portion 237. This is sufficient to allow insertion of the blades of a cutting tool, such as a pair of scissors, when the package is opened in a manner to be described. In this regard, FIG. 16 further shows how web 237 is provided with transverse cutting guides on both sides of the connector element 223, in the form of notches or grooves 239, the notches providing transverse paths of reduced thickness to facilitate cutting. The transverse lines E help indicate the direction of the notches 239. An arrow 250 is imprinted in the ring frame to show the direction of rotation for unlocking of a package when a rotatable segment is created, in a manner to be described hereinafter.

FIG. 16 also shows that the blister connector element 227 had a cylindrical wall 228 which can be received by the card opening 220 to register and laterally stabilize card 219. Note that the top of blister connector 227 has resiliently deformable opposing flaps 240 that are engagable by the two opposing lugs 236 on shaft 234.

It is further noted that the opening in the top of connector 227 has opposing recesses 242 that are configured to allow free passage of the connector lugs 236 when connector 223 is rotated 90 degrees to align lugs 236 with recesses 242 when the package is unlocked, in a manner to be described.

Figure 14:
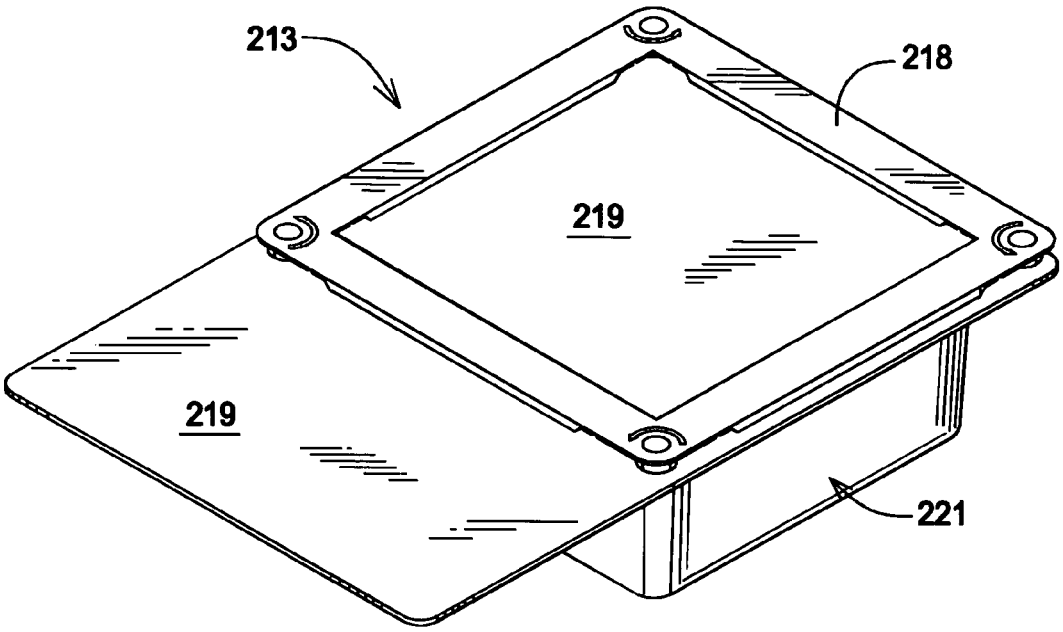
FIG. 14 is a top perspective view of the assembled package of FIG. 13.

Package 213 is used as follows. After articles of commerce are placed in cavity 224, the card 219 is positioned over the cavity with the circular card openings 220 embracing the cylindrical walls 228 of the connectors 227. Next the retainer connector elements 223 are aligned with blister elements 227 and then pressed downwardly to cause the lugs 236 to resiliently deform the flaps 240 which then snap into locking engagement with the top edges of the lugs 236 upon full insertion of shaft 234. FIGS. 14 and 15 show package 213 in locked configuration. The bottom view of FIG. 19 shows lugs 236 in locked engagement with the flaps 240.

The package 213 can be unlocked and opened in an easy and safe manner as follows.

Figure 17:
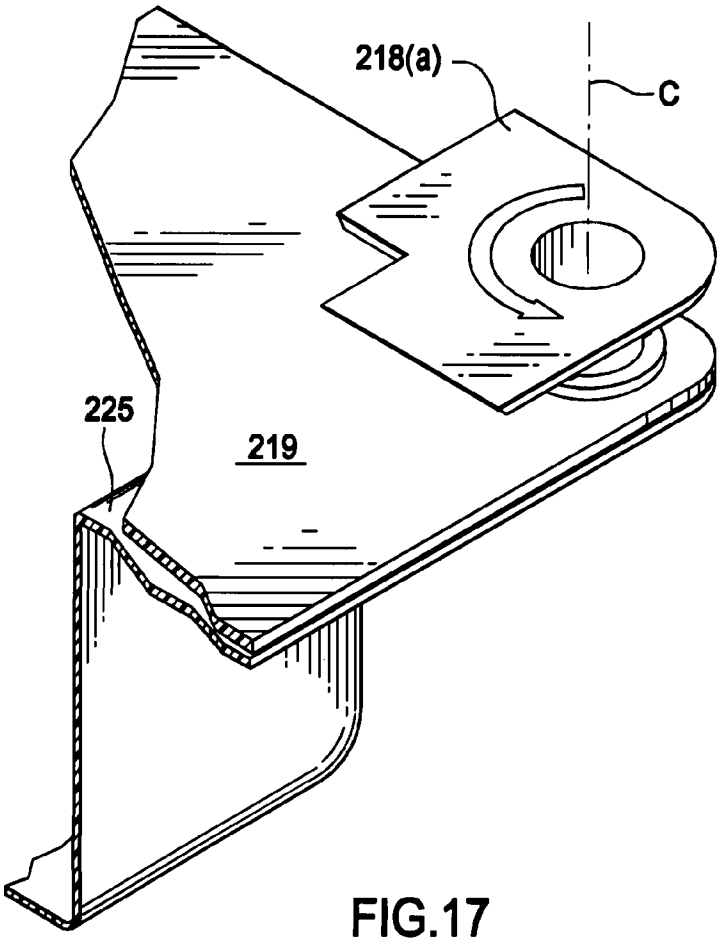
FIG. 17 is a partial enlarged perspective view of a corner region of the package of FIG. 14, showing a retainer segment in locked position.

Referring to FIGS. 15 and 16, when cutting tool blades are inserted in space 240 of package 213, cuts in the frame 218 along the notches 239 can be made to create free segments 218(*a*). See FIG. 17.

Figure 18:
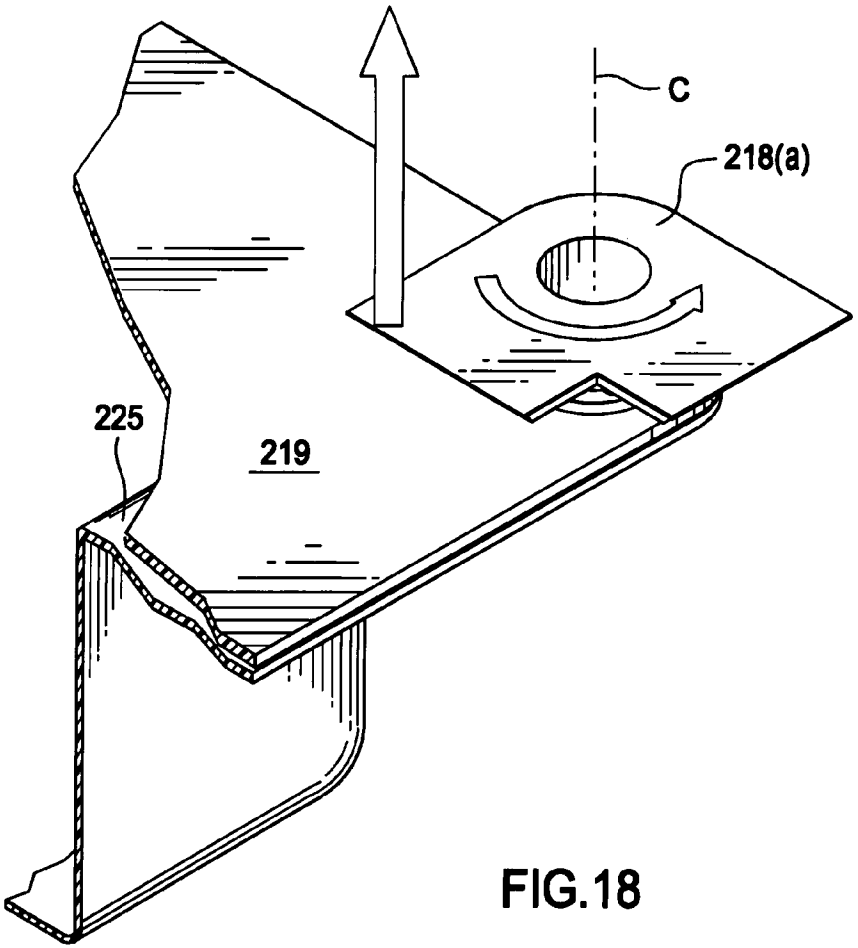
FIG. 18 is a view similar to FIG. 17, but showing a retainer segment rotated through 90° to its open position.
Figure 20:
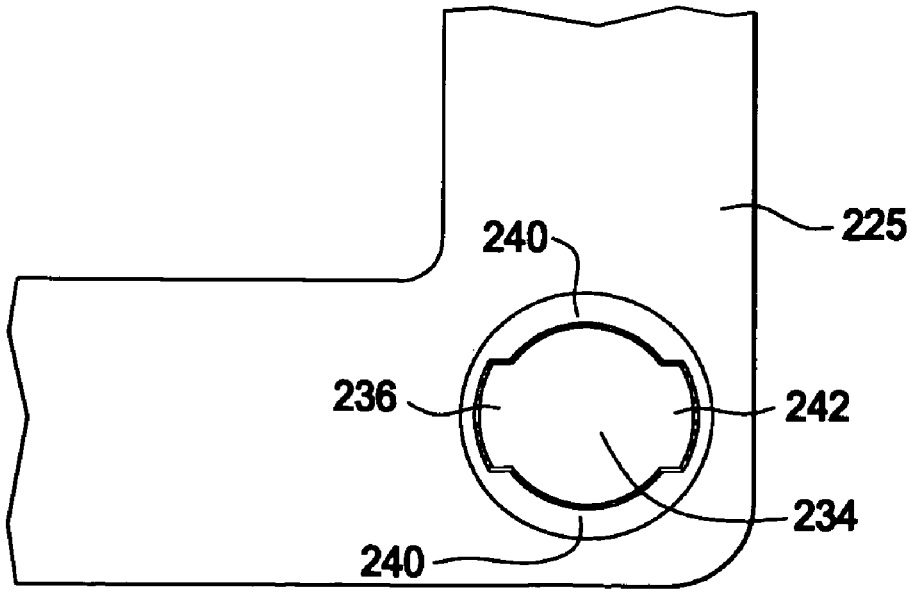
FIG. 20 is a view similar to FIG. 19 showing connector elements in open configuration.

Next, the segment 218(*a*) is rotated through 90 degrees to the position shown in FIG. 18. FIG. 20 shows how the lugs 236 are then aligned with the open portion 242 which allows segment 218(*a*) to be moved upwardly, as indicated in FIG. 18. The remaining connectors are manipulated in a similar fashion to unlock and open the package.

While particular embodiments of the invention have been shown, it is not intended that the invention be limited thereto. Various modifications and variations of the invention will be evident to persons of ordinary skill in the art, given the benefit of this disclosure, and it is intended that the invention be given its full scope and breath as defined in the claims that follow.

What is claimed is:

1. A card and blister package for small articles of commerce, comprising:

a) a blister piece having a cavity for holding said articles, and a flange portion, and a plurality of first connector elements spaced apart along said flange portion;

b) a card having a plurality of spaced apart openings, whereby said blister piece can engage said card to bring said first connector elements into alignment with said card openings;

c) a retainer ring having a frame and a plurality of second connector elements spaced apart therealong; and d) whereby, said package has a locked configuration in which said card covers said blister cavity, and said card openings are aligned respectively with said first connector elements and said second connector elements, and said first and second elements are adapted to be snapped into locking engagement with each other to secure said card between said flange and said retainer ring; and e) whereby rotation of said second connector elements relative to said retainer ring will cause said second elements to unlock from said first connector elements.

2. A package as defined in claim 1 wherein said second connector elements are rotated through about 90 degrees to unlock from said first elements.

3. A package as defined in claim 1 wherein each said second connector elements are integral to said retainer ring and contained in a detachable segment of said retainer ring that is adapted to be severably detached from said retainer ring to free said detachable segment for rotation relative to said retainer ring.

4. A package as defined in claim 3 wherein said second connector elements are adapted to be rotated through about 90 degrees to unlock from said first elements.

5. A package as defined in claim 3 wherein said first connector elements comprise locking posts extending upwardly from said flange portion, each said post having at least one side portion containing a locking cavity, and said second connector elements comprises downwardly-opening locking caps adapted for receiving said posts, and locking means within said caps for making locking engagement with said post locking cavity and wherein rotation of said cap relative to said retainer ring will move said locking means out of engagement with said locking cavity.

6. A package as defined in claim 5 wherein each said detachable segment includes a locking cap and has a perimeter characterized by a region of lessened structural integrity, whereby rotation of said cap will cause breakage and disconnection along said region of lessened structural integrity.

7. A package as defined in claim 6 wherein said region of lessened structural integrity comprises a plurality of perforations in said retainer ring.

8. A package as defined in claim 5 wherein each said post has at least one slanted edge portion on the upper end of said post for slidably engaging and urging apart said cap locking means.

9. A package as defined in claim 8 wherein said cap has oppositely disposed locking means.

10. A package as defined in claim 5 wherein said post includes opposing vertically extending flat surfaces, and rotation of said cap through about 90 degrees brings said locking means into alignment with said flat surface.

11. A package as defined in claim 5 wherein said locking means is resiliently deformable and comprises an inwardly projecting convex protrusion shaped to engage said cavity.

12. A package as defined in claim 11 wherein said convex protrusion and said locking cavity extend transversely with respect to said cap and post, respectively.

13. A package as defined in claim 12 wherein said locking cavity has a concave shape corresponding to said protrusion.

14. A package as defined in claim 1 wherein said retainer ring has a lower, flat surface for engaging the upper surface of said card and includes a first and a second transverse raised strip segment that is spaced from said lower surface, and said first raised portion is on one side of a cap and the second is on the other side, and whereby severing of said first and second portions will disconnect said cap from the remainder of said ring and allow rotation of said cap.

15. A package as defined in claim 3 wherein said detachable segment comprises at least one transversely extending integral strip in said frame defined by perforations in said frame, and a pull tab extending from one side of the strip.

16. A package as defined in claim 3 wherein said second connector element includes a downwardly projecting member having at least one locking lug projecting outwardly from the lower end of said member and having an upper edge, and said first connector element has walls that define an opening for receiving therethrough the lower end of said member, and including at least one inwardly projecting resiliently deformable flap adjoining said opening and which flap is adapted to be engaged by said lug, whereby said second connector is locked into engagement with said first connector when said lug is moved downwarly against said flap to cause it to deform and then snap into engagement with the upper edge of said lug, and wherein rotation of said member can move said lug out of engagement with said flap and into said opening.

17. A package as defined in claim 16 wherein said first connector element walls have a portion that is adapted for engaging said card opening to stabilize said card against lateral movement.

18. A package as defined in claim 16 including first and second said lug respectively on opposing sides of said member and a first and second opposingly disposed ones of said flaps.

19. A package as defined in claim 16 wherein said retainer frame has a lower surface for engaging said card, and said segment is spaced above the level of said lower surface to create an opening of insertion of cutting blades, and said region of lessened structural integrity comprises at least one transversely extending groove.

20. A package as defined in claim 19 wherein said segment is substantially thinner than the remainder of said frame.

* * * * *

UNITED STATES PATENT AND TRADEMARK OFFICE

CERTIFICATE OF CORRECTION

PATENT NO. : 7,717,267 B2
APPLICATION NO. : 12/283599
DATED : May 18, 2010
INVENTOR(S) : Paul Appelbaum It is certified that error appears in the above-identified patent and that said Letters Patent is hereby corrected as shown below:

On the title page item (76), line 1 "APPLEBAUM" should read "APPELBAUM"

Signed and Sealed this

Twentieth Day of July, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,717,267 B2
APPLICATION NO. : 12/283599
DATED : May 18, 2010
INVENTOR(S) : Paul Appelbaum It is certified that error appears in the above-identified patent and that said Letters Patent is hereby corrected as shown below:

On the title page item (12) and at item (76), line 1 "APPLEBAUM" should read "APPELBAUM"

This certificate supersedes the Certificate of Correction issued July 20, 2010.

Signed and Sealed this

Seventeenth Day of August, 2010

David J. Kappos

David J. Kappos
*Director of the United States Patent and Trademark Office*